US005983818A

United States Patent [19]

Tramutolo et al.

[11] Patent Number: 5,983,818

[45] Date of Patent: Nov. 16, 1999

[54] SEWING MACHINE WITH THREAD TENSIONING AND TAKE UP LEVERS

[75] Inventors: Sabino Tramutolo, Via Neera, 11 I-20141, Milan; Bruno Cordini, Via Torino, 83, I-20089 Rozzano, both of Italy

[73] Assignees: Sabino Tramutolo, Milano; Bruno Cordini, Rozzano, both of Italy

[21] Appl. No.: 09/160,475

[22] Filed: Sep. 24, 1998

Related U.S. Application Data

[63] Continuation of application No. PCT/EP97/01382, Mar. 19, 1997.

[30] Foreign Application Priority Data

Mar. 26, 1996 [IT] Italy ..... MI96A0631

[51] Int. Cl.[6] ..... D05B 49/00

[52] U.S. Cl. ..... 112/241; 112/475.17; 112/255

[58] Field of Search ..... 112/241, 245, 112/242, 244, 246, 254, 255, 475.17

[56] References Cited

U.S. PATENT DOCUMENTS

| | | | |
|---|---|---|---|
| 827,652 | 7/1906 | Onderdonk | 112/244 X |
| 860,546 | 7/1907 | Ives | 112/241 |
| 4,215,641 | 8/1980 | Dobrjansky et al. | 112/241 X |
| 4,907,517 | 3/1990 | Hanyu et al. | 112/241 X |
| 5,495,816 | 3/1996 | Sanvito et al. | 112/241 X |

*Primary Examiner*—Ismael Izaguirre

*Attorney, Agent, or Firm*—Cobrin & Gittes

[57] ABSTRACT

A sewing machine that has at least one needle which moves with alternating motion, taking the upper thread through the piece to the sewn, a shuttle to hook an upper thread to form a loop below the piece to be sewn, a bobbin housing in a bobbin-case located internally in the shuttle, the bobbin containing a lower thread which overlaps the upper thread through the loop, two mutually independent levers which act on the upper thread and are mobile with periodic motion between a position where the upper thread is allowed to be fed to the shuttle and a position of complete recovery of the upper thread in which the loop is closed to form a stitch, the upper thread being synchronized with movement of the levers by periodic tension.

13 Claims, 4 Drawing Sheets

SEWING MACHINE WITH THREAD TENSIONING AND TAKE UP LEVERS

This application is a continuation pending international application number PCT EP/97/01382, filed Mar. 19, 1997.

TECHNICAL FIELD

The present invention relates to a sewing machine and a method for sewing by machine. In particular, the invention relates to a sewing machine and a method for sewing fabric, leather and similar materials with a lock-stitch.

BACKGROUND ART

Sewing machines of this type are widely distributed and their method of operation is well known. In practical terms, taking a single-needle machine as an example for the sake of simplicity, the stitches are formed by interlocking an upper thread fed by the needle which moves with reciprocating action through the piece to be sewn, with a lower thread unwinding from a bobbin inside a shuttle or crochet which moves with a reciprocating or rotary action through a loop formed by the upper thread. When the two threads have formed the stitch, they are tensioned by a tensioning device and another device advances the piece being sewn by a stitch-length.

The terms "shuttle" or "crochet" used with reference to sewing machines generally refer to a rotating or oscillating mechanism with a hook which receives and hooks the upper thread carried by the needle, forms a loop and passes it around a bobbin-case which is housed in the shuttle and houses in turn a little bobbin on which the lower thread is wound. These elements are arranged to allow the loop to pass around the lower thread and the stitch to be formed once the loop is tightened. These operations are repeated at each revolution of the sewing machine thus effecting the sewing.

The device for tensioning the threads to form the stitch is usually a take-up lever which moves alternately up and down, drawing out the upper thread to supply thread for the formation of the loop on its downward stroke, and pulling the same thread in again on its upward stroke to tighten the loop formed by the shuttle.

All the actions of the moving parts, in particular the movements of the needle, the shuttle and the take-up lever, are synchronised in order to allow the correct operation of the machine.

One of the main limitations of the known sewing machines is that the lower bobbin thread is rapidly used up and the replacement operation is long, complex and troublesome; suffice it to recall that the bobbin must be changed on a standard industrial machine from 20 to 30 times during the working day.

It is known that the size of the shuttle, the bobbin-case and hence the bobbin are necessarily limited by the necessity of recovering the upper thread to close the loop. The limit is set by the stroke of the thread take-up lever which corresponds substantially to the length of the loop formed by the shuttle.

In the present art, various attempts have been made to overcome these limitations, providing in particular a number of passes of the upper thread between the same thread take-up lever and a series of fixed thread-guides in such a way as to multiply the length of upper thread recovered at each cycle. Some examples of the machines based on these ideas are described in the UK Patent Application N° GB 2027762, the French Patent N° FR 1000704 and the U.S. Pat. No. 4070976.

However, the simple multiplication of the thread recovered by multiple passes between a mobile thread take-up lever and fixed thread-guides has not always lead to correct closing of the loop. For this reason, the resultant stitching is substantially irregular, and of unsatisfactory quality. This is due to the fact that the solutions proposed in the prior art do not take account of the factors which influence the closing of the stitch.

Account must be taken of the extension of the upper thread as a result of the elasticity of the same when the thread take-up lever recovers the upper thread and closes the loop formed below the shuttle. The extension of the upper thread must be considered as a function of the total length of the portion of thread recovered during the cycle. This phenomenon increases in importance as the speed of sewing increases, hindering the efficient use in the industry of machines which use the multiplication of the recovered upper thread as described above.

Furthermore, the friction which is experienced by the upper thread as it passes repeatedly over the lever and the fixed guides causes differences in the tension of the thread upstream of any such pass and the tension downstream of the same pass. While faking all possible steps to reduce the friction of the thread (such as lapping the eye-holes or lining them with low-friction material), the total friction increases with the number of passes over the lever or guides, hindering correct control of the tension during the closing of the loop.

Another drawback of the sewing machine according to the prior art occurs when a particularly delicate thread, e.g. silk or the like, or particularly thin thread is used. In such cases, the thread take-up lever which recovers the upper thread exercises a tension on a particularly long section of the same thread. As a result, a certain section of upper thread is subjected to tension for a high number of cycles, often causing the thread to break. This drawback often means that continuous sewing for more than 30–40 cm without the upper thread breaking is not possible.

DISCLOSURE OF THE INVENTION

The aim of the present invention is to overcome the drawbacks of the prior art.

According to this aim, an object of the present invention is to provide a sewing machine which can use a larger sized bobbin for the lower thread. Another object of the present invention is to produce a sewing machine which will limit or eliminate altogether the imperfections in closing the loop formed by the shuttle, and therefore, the imperfections in the stitch, due to the excessive elastic stretching of the upper thread and of differences in tension caused by the friction on the upper thread along its course.

Yet another object of the present invention is to produce a sewing machine which will limit the tension stress imparted to the upper thread as each stitch is closed.

A further object of the present invention is to provide a method of sewing by machine which will improve the quality of sewing even at high sewing speeds.

These objects are achieved by the present invention, which relates to a machine for sewing textile, leather or similar materials, of the type comprising at least one needle which moves with alternating motion to bring the upper thread through the material, a shuttle which hooks the upper thread to form a loop below the piece to be sewn, a bobbin hosed in a bobbin-case lodged internally in the shuttle, the bobbin containing the lower thread which overlaps the upper thread through the loop, leverage means which move alternately from a position where the upper thread is allowed to be fed to the shuttle and a position in which the upper thread is completely recovered and the loop tightened to form the stitch, characterised in that the leverage means comprise at least two mutually independent mobile levers, and that there are provided means of tensioning the upper thread synchronised with the movement of the levers.

In this way it is possible to retain the advantages from a greater recovery of the upper thread and obtain stitching of appreciable quality even at high sewing speeds.

In one embodiment, assuming the course of the upper thread as reference, a first lever is positioned immediately downstream of a device for regulating the tension of the upper thread and a second lever is positioned immediately upstream of the needle, while the means of periodically tensioning the upper thread are located between the said levers.

In particular, in the case in which there are two thread take-up levers, a first lever recovers the greater part of the upper thread loop formed by the shuttle while the portion of the thread between the first lever and the needle is not under tension. The tension is applied to the upper thread only when the second lever, the one positioned lower along the course of the upper thread, closes the stitch.

The principle is also applicable to known types of sewing machine, independently of the size of the shuttle and the lower thread bobbin, for the purpose of improving the sewing operation with particularly thin threads. This is advantageous as it reduces the stroke of the thread take-up lever and thus reduces the length of the upper thread that is subjected to tension stress at each stitch-closing cycle, significantly reducing the stress that causes particularly thin threads to break.

Of course, it is possible to obtain further advantages by providing more than two thread take-up levers, compatible with the resulting friction problem which slows the correct running of the thread.

According to a preferred aspect of the invention, the levers are mobile with alternating motion at the same frequency but with a phase difference and, in particular, the first lever being in advance of the second (or the second being retarded with respect to the first).

The means of applying tension to the upper thread are activated in the interval between the instant of complete recovery of the upper thread by the same first lever and the successive instant of reaching the same position by the second lever.

In practice, with this arrangement it is the second lever which finally closes the stitch, acting on a limited section of the upper thread and not on the entire length recovered by both levers.

In the cases in which more than two levers are provided, the means of applying tension to the upper thread are activated immediately before the stitch is closed by the lever that is furthest downstream with respect to the direction of movement of the upper thread.

Preferably, the shuttle is large enough to form a loop whose linear extension is substantially as long as the length of the thread drawn out and recovered by the take-up levers.

The shuttle may be of such a size as to use larger bobbins. In practical terms, the bobbins in this case could contain between 1300 and 1800 metres of thread or more depending on the diameter of the thread, considerably more than, the 30 to 50 metres of the bobbins used in the known sewing machines. One bobbin alone could suffice for an entire day's continuous sewing, even at high production speeds.

The bobbin-case i.e. the element housing the bobbin, preferably comprises at least one seat for the location of means for tensioning the lower thread from the bobbin.

In particular, said seat is cut directly into the wall of the bobbin-case and has at least one opening turned inward towards the interior i.e. towards the bobbin.

Said means for tensioning the lower thread consist of a support plate to be inserted into the seat on the bobbin-case, an elastic element on said plate, a plurality of through holes on the plate to guide the thread along under the influence of said elastic element and means to regulate the tension of the elastic element on the thread.

For instance, the elastic element could be a tension leaf spring very like to that used in present sewing machines. Similarly, the means for regulating the tension could be a screw which varies the pressure of the leaf spring on the thread passing between the spring and said plate.

The means for tensioning the bobbin thread are preferably removable from its seat to facilitate the regulation of the thread tension.

The plate of the tensioning means for the lower thread includes in particular an entry hole for the thread from the bobbin. In working position, i.e. when the plate is inserted into its seat in the bobbin-case, the entry hole is substantially aligned with the mid-point of the bobbin axis.

In other words the entry hole is the fixed outlet for the thread running off the bobbin and should be equally placed towards any run-off direction of the thread.

The invention further relates to a method of machine sewing textile, leather or similar materials, in which a needle carries an upper thread through a piece to be sewn until it is hooked by a shuttle to form a loop round the same shuttle below the piece to be sewn, and then to be again recovered by mobile levers moving in conjunction with the needle, characterised by providing the passage of the upper thread through at least two mutually independent mobile levers and the periodic application of tension to the upper thread, synchronised with the movement of the levers.

According to a preferred aspect of the invention, the levers move periodically at the same frequency, but the first lever is out of phase in advance of the second or the second is out of phase but retarded with respect to the first.

The method also provides the intervention by means of periodically tensioning the upper thread in the interval between the position of maximum recovery of the upper thread being reached by the first lever and the same position being reached by the second lever.

BEST MODE FOR CARRYING OUT THE INVENTION

The invention will now be described in more detail with reference to the attached drawings which are of an illustrative but non-limiting nature and in which.

Figure 1:
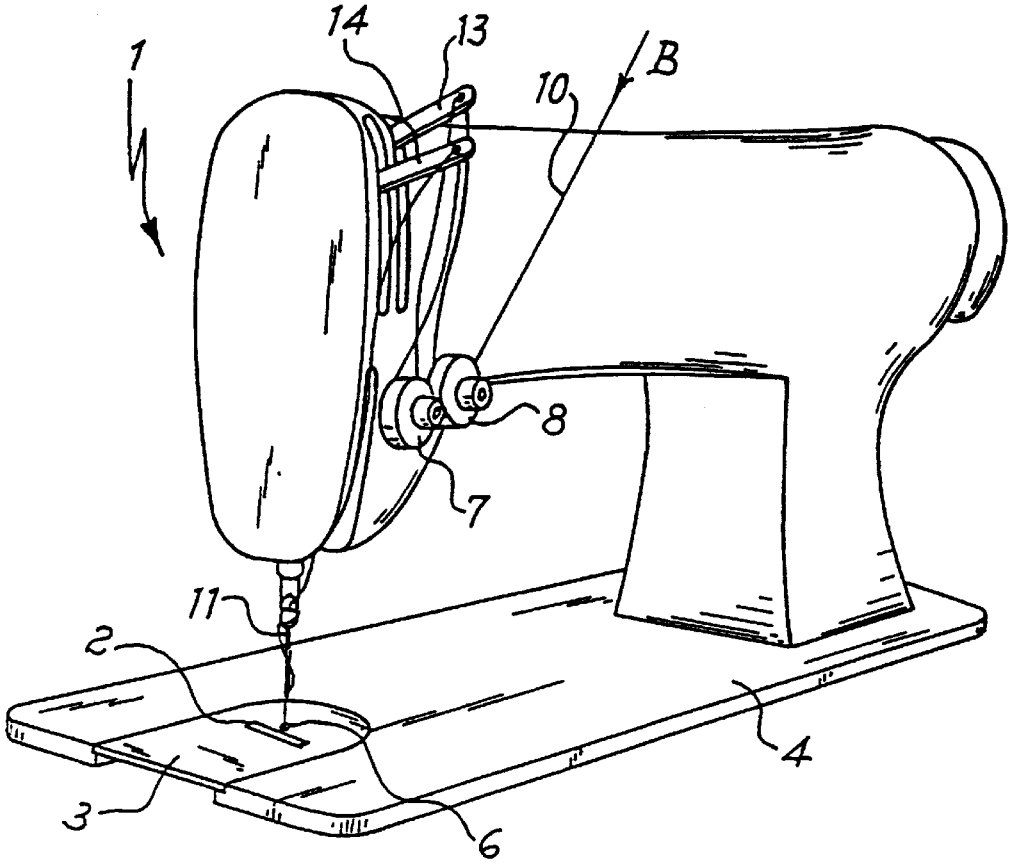
FIG. 1 is a perspective view of a sewing machine according to the invention.

FIG. 1 shows, in its basic essential elements, a sewing machine 1 fitted with a needle 11 which, moving in a reciprocating way, carries an upper thread 10 through a piece 9 to be sewn (FIGS. 8A–8C) and through a little hole 6 in a removable plate 3 of the work surface 4. The plate 3 is further provided with a slot 2 for the fabric advancing element (not shown).

The upper thread 10. which runs in the direction of arrow B, is fed from a spool (not shown) mounted on the outside of the machine 1 and is brought below the plate 3 where a shuttle 12 (FIG. 2) hooks the thread 10 and draws out a loop 5 by a rotary movement in the direction of arrow R. The shuttle 12 can have either a completely rotary or an oscillatory movement in both directions around the same axis. In the first case the shuttle 12 rotates constantly in the direction of arrow R; in the second case the shuttle 12 moves in the direction of arrow R until the loop is completely formed and then it returns in the opposite direction before hooking the upper thread 10 once again to form the next loop.

Figure 2:
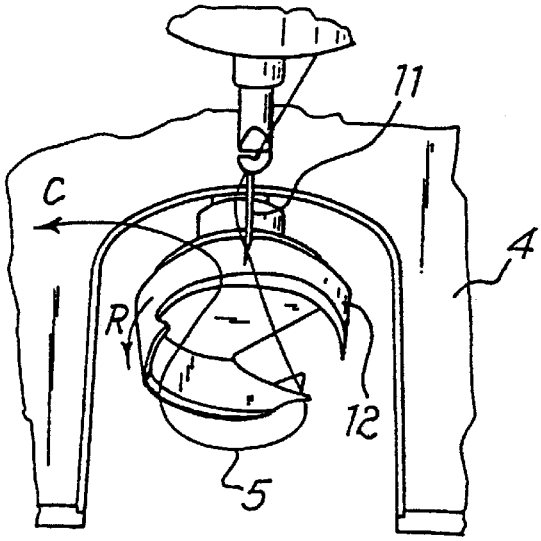
FIG. 2 is a perspective view of a detail of the sewing machine according to the invention.

The arrow C in FIG. 2 indicates the direction of the upper thread running to the stitching already formed.

With reference to FIG. 1 again, the machine 1 according to the invention comprises two thread take-up levers 13 and 14 which move mutually independently, i.e. with an alternating motion at the same frequency but out of phase with each other.

In particular, the first thread take-up lever 13 is out of phase in advance of the second 14 or, inverting the reference system, the second 14 is out of phase but retarded with respect to the first 13.

For example, when the levers 13 and 14 are moving upwards to recover the upper thread and close the loop 5 formed by the shuttle 12, the first lever 13 reaches the top dead point before the second lever 14 has completed its stroke.

Between the first lever 13 and the second lever 14 there are provided means 7 of periodically tensioning the upper thread 10 synchronised with the movement of the levers 13 and 14. In practice, with respect to the direction of the run of the upper thread from the bobbin to the needle, the first lever 13 is located immediately downstream of the tension-regulating device 8 of the upper thread 10, the second lever 14 is located immediately upstream of the needle 11, while the means 7 of periodically tensioning the upper thread 10 are located between levers 13 and 14.

Figure 3:
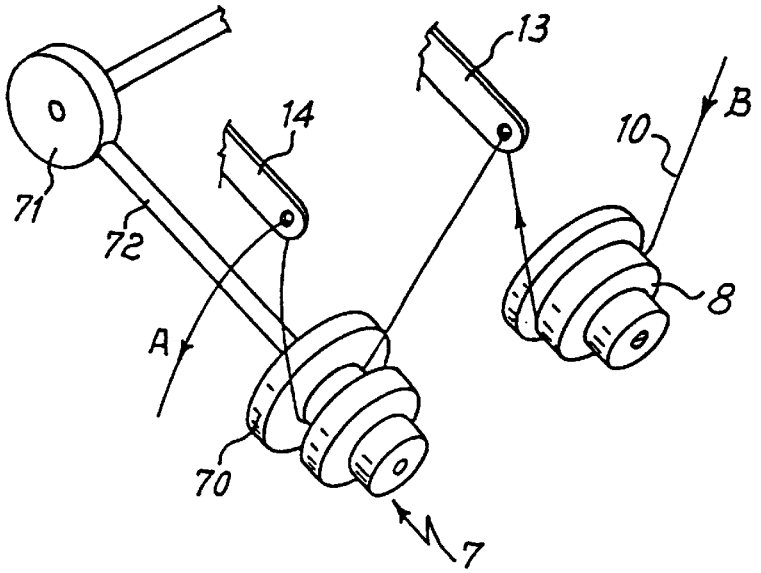
FIG. 3 is a perspective view showing a detail of the layout of the upper thread on a sewing machine according to the invention.

This arrangement is shown in greater detail in FIG. 3. The direction of run of the upper thread 10 is indicated by the arrow B at the end of the thread leaving the bobbin, and by the arrow A at the end of the thread 10 which is directed towards the needle 11, together with the remaining intermediate arrows indicated on thread 10 along its course.

In the embodiment shown schematically in FIG. 3, the means 7 of periodically tensioning the upper thread 10 comprise a thread-tensioning device 70 (shown as inactive and very markedly open with respect to the real inactive position) which is operated by a cam 71, linked mechanically to the motor shaft by the pin 72. The thread-tensioning device 70, which can preferably be regulated, exercises its tensioning effect on the upper thread 10 in the interval between the instant of lever 13 reaching the top dead point and the next instant when the lever 14 reaches the same point.

This arrangement, as well as considerably increasing the length of thread recovered by the levers 13 and 14, also allows the loop 5 to be completely and efficiently closed, i.e. the total recovery of the upper thread. Besides allowing a larger shuttle 12 than usual to be used, the final closing of the loop 5 is done only by the lever 14 acting on the portion of thread between the means 7 of periodically tensioning the upper thread and the stitch-point, as happens in the present machines with only one thread take-up lever. This arrangement also avoids those drawbacks of the present machines with multiple levers, or with multiple passes of the thread over the same lever, which multiply the length of thread recovered at each cycle without taking account of the factors which influence the closing of the stitch, i.e. the relative elongation of a portion of the thread of considerable length and the unbalancing of the tensions due to the friction which acts on the upper thread at the various passes over the lever and the thread-tensioning device, as well as across any thread guides which may be provided along the course of the thread itself.

As is known, the eyes in the levers 13 and 14 through which the thread passes are suitable treated or coated on the surface to expedite the running of the thread. Furthermore, additional fixed thread-guides may be provided, e.g. upstream and downstream of the means 7 of periodically tensioning the thread 10, for the purpose of avoiding entanglements of the thread itself and facilitating the movement along its course.

An increase in shuttle 12 size allows an increase in the size of those elements contained within it. As can be seen from the exploded view of FIG. 4, the shuttle 12 contains a bobbin-case 18 which contains a bobbin 19 on which the lower thread 20 i.e. the thread which is surrounded by the upper thread 10 to form the stitch, is wound. The bobbin 19 is interchangeable and can rotate on a spigot 25 of the bobbin-case 18. For instance, the bobbin 19 can be held in position by a retainer stud 27 with a rubber ring 28 which can be push fit in the hole 26 of the spigot 25, or by other known holding means in the hole 26. such as a screw engaged with a corresponding internal thread in the hole 26 or a "click-fit" or similar retainer.

The bobbin-case 18 is floating inside the shuttle, in such a way as to pass the loop 5 completely around the bobbin-case itself until it meets the lower thread 20. The recovery of the upper thread 10, made firstly by both the levers 13 and 14 and finally by the take-up lever 14 only, closes the loop 5 intercepting the lower thread 20 which runs out from the bobbin-case 18 through a slot 21.

The shuttle 12 can be large enough to form a loop 5 whose linear extension is substantially as long as the length of thread 10 drawn out and recovered at each cycle by the take-up levers 13 and 14. Then, it is possible to use a bobbin 19 with considerable increase in useful space than at present.

Figure 4:
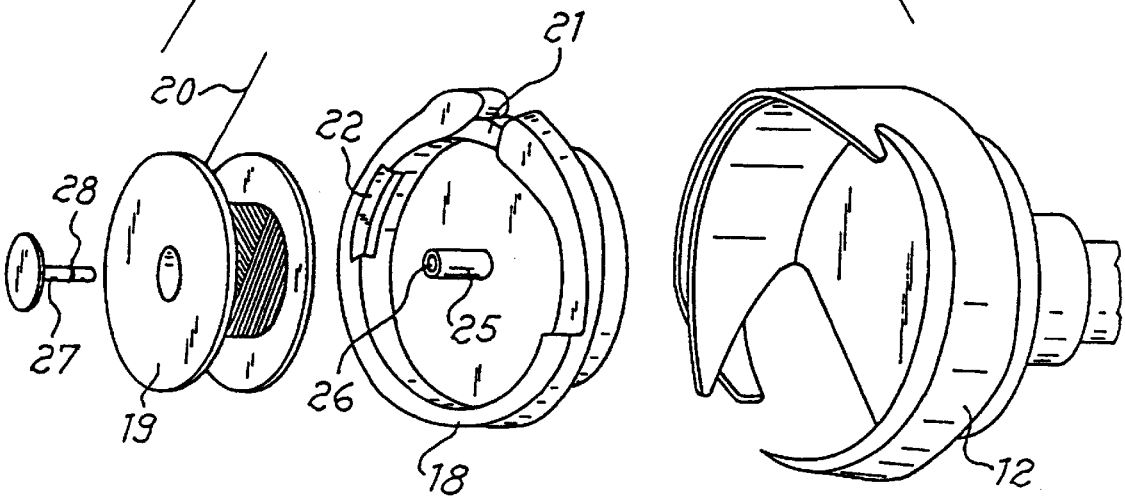
FIG. 4 is an exploded view of some elements of the machine according to the present invention.
Figure 5:
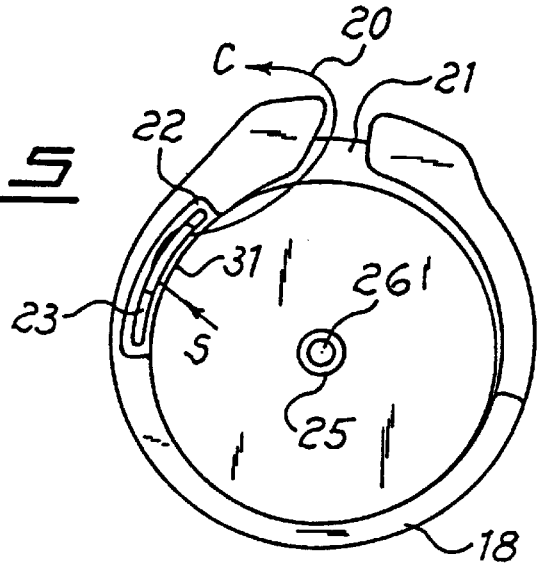
FIG. 5 is a front view of the bobbin-case of the machine according to the present invention.
Figure 6:
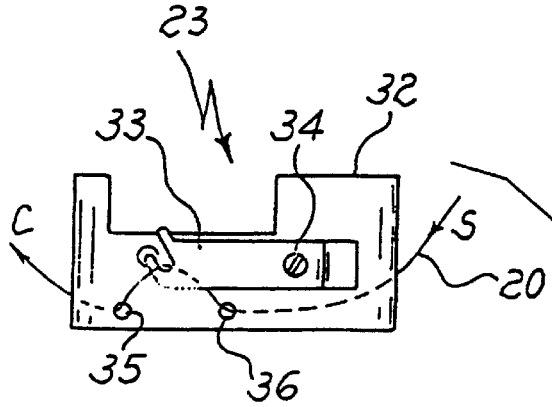
FIG. 6 shows respectively a front view and plan view of the means for tensioning of the lower thread of the machine according to the present invention.
Figure 6:
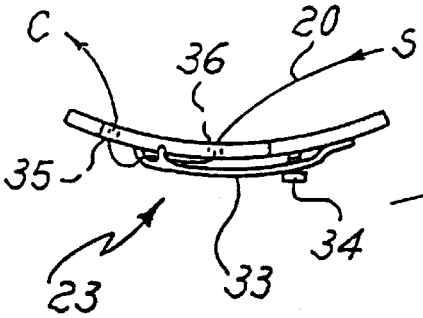
Figure 7:
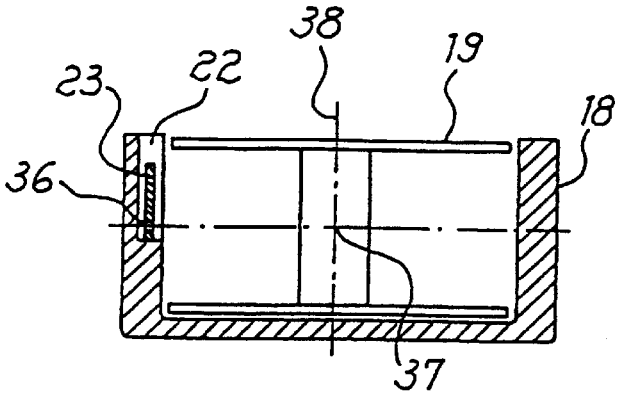
FIG. 7 is a cross-sectional view the layout of the tensioning means as shown in FIG. 6 in the bobbin-case of FIG. 5.

With reference to FIG. 4 and the following FIGS. 5, 6 and 7, the bobbin-case 18 comprises a seat 22 in which means 23 are housed for tensioning the lower thread 20 wound around the bobbin 19. Said tensioning means 23 are preferably removable from its seat 22 to facilitate the regulation of the tension of the lower thread 20.

Preferably, the seat 22 is cut into the wall of the bobbin-case 18 and comprises an opening 31 turned towards the interior of the bobbin-case 18 so as to face the bobbin 19. In FIGS. 5 and 6, the direction of run of the lower thread 20 for the end towards the bobbin 19 is shown by the arrow S and the direction of run of the lower thread 20 for the end towards and toward the stitching is shown by the arrow C.

With particular reference to the two views of FIG. 6, the means 23 for tensioning the lower thread 20 comprise a support plate 32 of a suitable shape and size to fit into the seat 22. An elastic element 33 is mounted on the support plate 32 and is provided with a regulating screw 34 to regulate the pressure of the elastic element 33 on the lower thread 20. The support plate 32 also comprises two large bore holes 35, 36 to guide the lower thread 20 along a path where the elastic element 33 could exert its pressure.

As it is evident from FIG. 7, the entry hole 36 for the lower thread 20 running off the bobbin 19 is substantially aligned with the centre point 37 of the axis 38 of bobbin 19.

The position of the hole 36 ensures that the lower thread 20 runs correctly off the bobbin 19 whatever the state of loading of the bobbin 19. Indeed, the lower thread 20 is initially wound onto bobbin 19 by guiding it across the full width of the bobbin 19 with a periodically oscillating rhythm to load it evenly. Because of this, the lower thread 20 continually changes direction running off the bobbin 19 but always stays half-way between the two ends of the bobbin 19 and the rotary motion of the bobbin 19 is more regular as a result. This is not possible with known sewing machines since the reduced size of the shuttle and the bobbin-case force the location of the means for tensioning the lower thread in an asymmetrical position with respect to center point of the bobbin 19. Consequently, in the known sewing machines the direction of the lower thread running off the bobbin is noticeably unbalanced towards one side of the bobbin, causing irregular rotation of the same bobbin while unwinding.

Figure 8A:
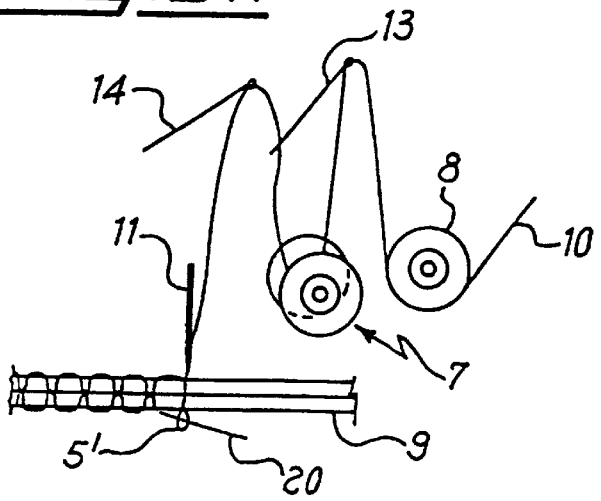
FIGS. 8A, 8B, 8C are schematic views which illustrate some steps of the sewing method according to the present invention.
Figure 8B:
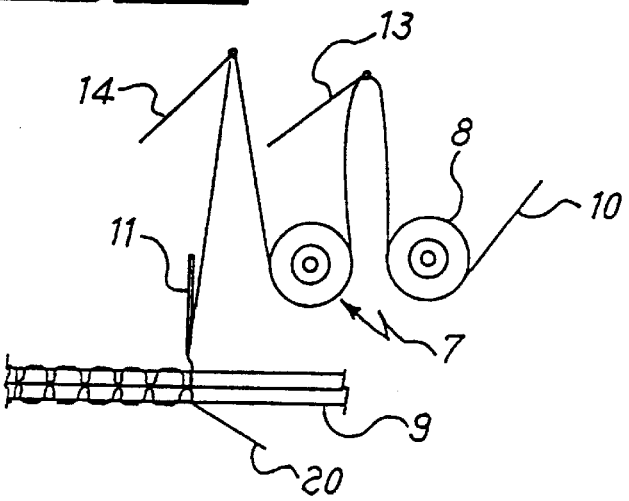
Figure 8C:
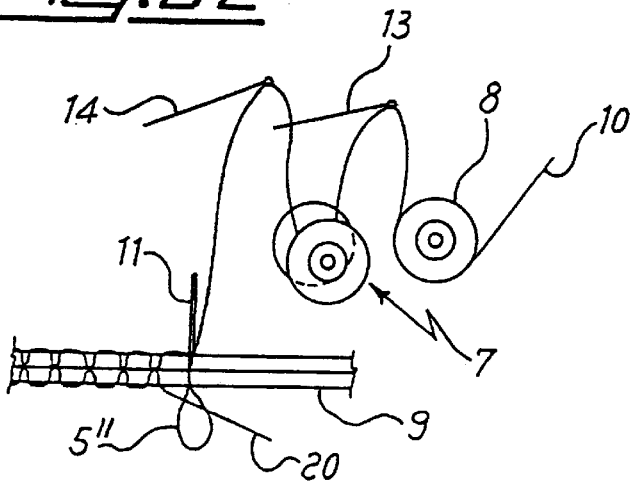

FIGS. 8A–8C illustrate schematically some steps of the method of machine sewing according to the invention. In FIGS. 8A and 8C the means 7 of periodically tensioning the thread 10 are shown in the open (or inactive) condition: a mobile part has been rotated off-centre with respect to a stationary part; in FIG. 3B the means 7 are shown in the closed (or active) position: the mobile part has been located coaxially against the fixed part. FIG. 8A shows the first lever 13 having reached its top dead point while the second lever 14 is still moving upwards to close the remaining loop 5' around the lower thread 20. At this point, the means 7 of periodically tensioning the thread 10 are activated in such a way as to change from a state of freely allowing passage of the upper thread (FIG. 8A) to a state of putting the upper thread under tension (FIG. 8B) until the lever 14 in its turn reaches the top dead point, the point at which the stitch is closed. Immediately after the closing of the stitch as shown in FIG. 8C, the means 7 of periodically tensioning the thread 10 are opened again, the needle 11 passes through the piece to be sewn 9 taking the thread 10 to be hooked by the shuttle to form a new loop 5" which will go to make the next loop, while the levers 13 and 14 move downwards to feed more thread 10 to the shuttle.

Figure 9:
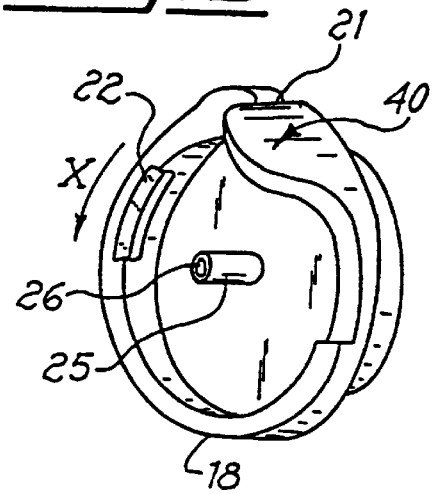
FIGS. 9 and 10 show, in perspective and respectively in a plane, an advantageous embodiment of the bobbin case.
Figure 10:
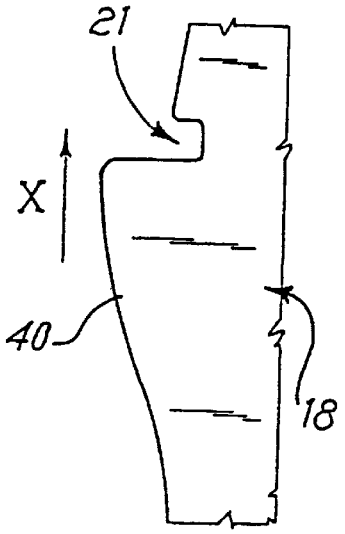

FIGS. 9 and 10 respectively show, in a perspective view and in plane, a preferred embodiment of the bobbin case 18. This bobbin case 18, contrary to what shown in FIG. 4, has a circumferential portion 40 axially protruding with a cam shape in a part of the bobbin case placed upstream of said passage 21, when the shuttle direction of rotation X is considered. This portion 40, which initially protrudes and then is shaped to gradually conform to the bobbin case configuration, operates to maintain the loop 5 shifted to the bobbin case outer side in the last step of upper thread recovery, so to avoid this loop to be newly hooked a second time by the shuttle continuing its rotational movement.

We claim:

1. Sewing machine, comprising at least one needle which moves with alternating motion, taking an upper thread through the piece to be sewn, a shuttle to hook the upper thread to form a loop below the piece to be sewn, a bobbin housing in a bobbin-case located internally in the shuttle, the bobbin containing a lower thread which overlaps the upper thread through the loop, leverage means which act on the upper thread and are mobile with periodic motion between a position where the upper thread is allowed to be fed to the shuttle and a position of complete recovery of the upper thread in which the loop is closed to form a stitch, characterized in that said leverage means comprise at least two mutually independent mobile levers, and that there are provided means of periodically tensioning the upper thread synchronized with movement of said levers, the levers being mobile with a periodic motion at the same frequency but being out of phase with each other.

2. A machine according to claim 1, characterised by the first of the said levers being immediately downstream of a device for the regulation of the tension in the said upper thread with respect to the direction of the said upper thread, a second of the said levers being located immediately upstream of the said needle, and by the said means for tensioning the said upper thread being located between the said first and second levers.

3. A machine according to claim 1, characterised by the first lever being in advance of the second lever.

4. Sewing machine, comprising at least one needle which moves with alternating motion, taking the upper thread through the piece to be sewn, a shuttle to hook an upper thread to form a loop below the piece to be sewn, a bobbin housing in a bobbin-case located internally in the shuttle, the bobbin containing a lower thread which overlaps the upper thread through the loop, leverage means which act on the upper thread and are mobile with periodic motion between a position where the upper thread is allowed to be fed to the shuttle and a position of complete recovery of the upper thread in which the loop is closed to form a stitch, characterized in that said leverage means comprise at least two mutually independent mobile levers, and that there are provided means of periodically tensioning the upper thread synchronized with movement of said levers, the means of periodically tensioning the upper thread being active in an interval between an instant the first lever completes recovery of the upper thread and an instant the second lever reaches the same position.

5. Sewing machine, comprising at least one needle which moves with alternating motion, taking the upper thread through the piece to be sewn, a shuttle to hook an upper thread to form a loop below the piece to be sewn, a bobbin housing in a bobbin-case located internally in the shuttle, the bobbin containing a lower thread which overlaps the upper thread through the loop, leverage means which act on the upper thread and are mobile with periodic motion between a position where the upper thread is allowed to be fed to the shuttle and a position of complete recovery of the upper thread in which the loop is closed to form a stitch, characterized in that said leverage means comprise at least two mutually independent mobile levers, and that there are provided means of periodically tensioning the upper thread synchronized with movement of said levers, said shuttle forming a loop whose linear extension is substantially as long as a of length thread drawn out and recovered by said take-up levers.

6. Sewing machine, comprising at least one needle which moves with alternating motion, taking the upper thread through the piece to be sewn, a shuttle to hook an upper thread to form a loop below the piece to be sewn, a bobbin housing in a bobbin-case located internally in the shuttle, the bobbin containing a lower thread which overlaps the upper thread through the loop, leverage means which act on the upper thread and are mobile with periodic motion between a position where the upper thread is allowed to be fed to the shuttle and a position of complete recovery of the upper thread in which the loop is closed to form a stitch, characterized in that said leverage means comprise at least two mutually independent mobile levers, and that there are provided means of periodically tensioning the upper thread synchronized with movement of said levers, said bobbin-case comprises at least one seat for a location of means for tensioning the lower thread wound on said bobbin.

7. A machine according to claim 6, characterised in that said seat is cut directly into the wall of the bobbin-case and has at least one opening facing towards the interior of said bobbin-case.

8. A machine according to claim 6, characterised in that said tensioning means comprise a support plate to be inserted into said seat on the bobbin-case, an elastic element mounted on said plate, at least two through holes on the plate to guide said lower thread along a path under the influence of said elastic element, as well as means to regulate the tension of said elastic element on said thread.

9. A machine according to claim 6, characterised in that said means for tensioning said lower thread are removable from said seat on the bobbin-case.

10. A machine according to claim 6, characterised in that said means for tensioning the lower thread, housed into said seat of the bobbin-case, include at least one entry hole for said thread from said bobbin, said entry hole being substantially aligned with the mid-point of the bobbin axis.

11. Sewing machine, comprising at least one needle which moves with alternating motion, taking the tipper thread through the piece to be sewn, a shuttle to hook an upper thread to form a loop below the piece to be sewn, a bobbin housing in a bobbin-case located internally in the shuttle, the bobbin containing a lower thread which overlaps the upper thread through the loop, leverage means which act on the upper thread and are mobile with periodic motion between a position where the upper thread is allowed to be fed to the shuttle and a position of complete recovery of the upper thread in which the loop is closed to form a stitch, characterized in that said leverage means comprise at least two mutually independent mobile levers, and that there are provided means of periodically tensioning the upper thread synchronized with movement of said levers, said bobbin case showing in a position upstream a lower thread passage off the case, when considering the shuttle direction of rotation, a cam shaped circumferential portion axially protruding to shift the upper thread loop from a shuttle path during a last upper thread recovery step.

12. Method for machine sewing in which a needle carries an upper thread through a piece to be sewn until it is hooked by a shuttle to form a loop around the shuttle below the piece to be sewn, and then is recovered by means of mobile levers moving, together with the needle, characterized by providing the passage of said upper thread through at least two mutually independent mobile levers and by applying a periodic tension to said upper thread synchronized with movement of the levers, the levers moving with periodic motion at the same frequency, a first of said levers being out of phase in advance with respect to a second of said levers.

13. A method according to claim 12, characterised by applying a tension to the said upper thread in the interval between the position of maximum recovery of the upper thread by said first lever and the reaching of the same position by said second lever.

* * * * *

UNITED STATES PATENT AND TRADEMARK OFFICE

CERTIFICATE OF CORRECTION

PATENT NO. : 5,983,818

DATED : November 16, 1999

INVENTOR(S) : Sabino Tramutolo

It is certified that error appears in the above-identified patent and that said Letters Patent is hereby corrected as shown below:

On the cover page under "[30] Foreign Application Priority Data", change "March 26, 1996" to --March 29, 1996--.

Signed and Sealed this

Twenty-third Day of May, 2000

*Attest:*

Q. TODD DICKINSON

*Attesting Officer*

*Director of Patents and Trademarks*